US009618017B2

(12) United States Patent
Bae et al.

(10) Patent No.: US 9,618,017 B2
(45) Date of Patent: Apr. 11, 2017

(54) HYDRAULIC SYSTEM FOR CONSTRUCTION EQUIPMENT

(75) Inventors: Sang-Ki Bae, Changwon-si (KR); Jae-Hoon Lee, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 220 days.

(21) Appl. No.: 14/390,328

(22) PCT Filed: Apr. 17, 2012

(86) PCT No.: PCT/KR2012/002918
§ 371 (c)(1),
(2), (4) Date: Oct. 2, 2014

(87) PCT Pub. No.: WO2013/157672
PCT Pub. Date: Oct. 24, 2013

(65) Prior Publication Data

US 2015/0059329 A1 Mar. 5, 2015

(51) Int. Cl.
*F15B 11/05* (2006.01)
*E02F 9/22* (2006.01)
(Continued)

(52) U.S. Cl.
CPC ..... *F15B 11/055* (2013.01); *E02F 9/123* (2013.01); *E02F 9/2228* (2013.01);
(Continued)

(58) Field of Classification Search
CPC ..... F15B 11/05; F15B 11/055; E02F 9/2228
See application file for complete search history.

(56) References Cited

U.S. PATENT DOCUMENTS 5,315,826 A 5/1994 Hirata et al.
5,642,616 A 7/1997 Park
(Continued)

FOREIGN PATENT DOCUMENTS

JP 08-093002 A 4/1996
KR 10-1996-0006358 B1 5/1996
(Continued)

OTHER PUBLICATIONS

International Search Report (in Korean and English) and Written Opinion (in Korean) for PCT/KR2012/002918, mailed Dec. 6, 2012; ISA/KR.

*Primary Examiner* — F. Daniel Lopez
(74) *Attorney, Agent, or Firm* — Harness, Dickey & Pierce, P.L.C.

(57) ABSTRACT

A hydraulic system for a construction machine having a pressure compensation valve is disclosed, which improves operability when a combined operation of a swing device and an attachment is performed. The hydraulic system includes a hydraulic pump, attachment and swing operation devices, an attachment actuator and a swing motor connected to the hydraulic pump, a first control valve controlling hydraulic fluid being supplied to the actuator, a second control valve controlling hydraulic fluid being supplied to the swing motor, a check valve installed on a flow path for detecting load pressures of the actuator to take a maximum pressure of the load pressures, a first pressure compensation valve having an opening amount that is controlled by a difference between the maximum load sensing pressure and the pressure of a discharge flow path of the first control valve, a second pressure compensation valve having an opening amount that is controlled by a difference between the maximum load sensing pressure and the pressure of the discharge flow path of the second control valve, a maximum load pressure sensor detecting the pressure of a maximum
(Continued)

load sensing pressure line, and a control unit controlling a discharge flow rate of the hydraulic pump, wherein the system is configured so that the swing load pressure is not connected to the first pressure compensation valve on the attachment side when a combined operation of the swing device and the attachment is performed.

4 Claims, 2 Drawing Sheets

(51) Int. Cl.
*E02F 9/12* (2006.01)
*F15B 11/16* (2006.01)

(52) U.S. Cl.
CPC ..... *E02F 9/2235* (2013.01); *E02F 9/2285* (2013.01); *E02F 9/2296* (2013.01); *F15B 11/165* (2013.01); *F15B 2211/20546* (2013.01); *F15B 2211/25* (2013.01); *F15B 2211/253* (2013.01); *F15B 2211/605* (2013.01); *F15B 2211/6309* (2013.01); *F15B 2211/6313* (2013.01); *F15B 2211/6316* (2013.01); *F15B 2211/65* (2013.01); *F15B 2211/651* (2013.01); *F15B 2211/6652* (2013.01); *F15B 2211/7058* (2013.01); *F15B 2211/7135* (2013.01); *F15B 2211/78* (2013.01)

(56) References Cited

U.S. PATENT DOCUMENTS

| | | | | |
|---|---|---|---|---|
| 5,873,245 | A | 2/1999 | Kato et al. | |
| 7,520,130 | B2 * | 4/2009 | Tanaka | F15B 11/17 60/421 |
| 7,992,384 | B2 * | 8/2011 | Itakura | E02F 9/2228 60/421 |
| 8,838,349 | B2 | 9/2014 | Bae et al. | |
| 2011/0265467 | A1 | 11/2011 | Kawasaki | |
| 2013/0276441 | A1 | 10/2013 | Bae et al. | |
| 2014/0090368 | A1 | 4/2014 | Bae et al. | |
| 2014/0137549 | A1 | 5/2014 | Bae et al. | |

FOREIGN PATENT DOCUMENTS

| | | | |
|---|---|---|---|
| KR | 10-1997-0006933 | A | 2/1997 |
| KR | 10-2011-0093935 | A | 8/2011 |

* cited by examiner

— PRIOR ART—

HYDRAULIC SYSTEM FOR CONSTRUCTION EQUIPMENT

TECHNICAL FIELD

The present invention relates to a hydraulic system for a construction machine. More particularly, the present invention relates to a hydraulic system for a construction machine having a pressure compensation valve, which can improve operability when a combined operation of a swing device and an attachment is performed.

BACKGROUND OF THE INVENTION

A hydraulic system for a construction machine in the related art, as illustrated in FIG. 1, includes a variable displacement hydraulic pump (hereinafter referred to as a "hydraulic pump") 1 connected to an engine (not illustrated); an attachment operation device 2 and a swing operation device 3 outputting operation signals in proportion to operator's operation amounts; at least one attachment actuator 5 connected to a discharge flow path 4 of the hydraulic pump 1 to be driven by the operation of the attachment operation device 2; a swing motor 7 connected to a flow path 6 branched from the discharge flow path 4 to be driven by the operation of the swing operation device 3; at least one first control valve 8 installed in the discharge flow path 4 and shifted to control a start, a stop, and a direction change of the actuator 5 in response to the operation of the attachment operation device 2; a second control valve 9 installed in a flow path 6 and shifted to control a start, a stop, and a direction change of the swing motor 7 in response to the operation of the swing operation device 3; check valves 20 and 21 respectively installed in flow paths a and b for detecting load pressures of the attachment actuator 5 and the swing motor 7 to take a maximum pressure (i.e., maximum load sensing pressure) of the detected load pressures; a first pressure compensation valve 10 installed on a downstream side of the discharge flow path 4 to have an opening amount that is controlled by a difference between the maximum load sensing pressure and the pressure on the downstream side of the discharge flow path 4; a second pressure compensation valve 11 installed on the downstream side of the flow path 6 to have an opening amount that is controlled by a difference between the maximum load sensing pressure and the pressure on the downstream side of the flow path 6; and a control unit 16 receiving an input of detection values of a detection means 14 for detecting the operation amount of the attachment operation device 2, a detection means 15 for detecting the operation amount of the swing operation device 3, a maximum load pressure sensor 13 detecting a maximum load sensing pressure; and a pressure sensor 12 for detecting a discharge pressure of the hydraulic pump 1, and outputting a control signal for controlling a discharge flow rate of the hydraulic pump 1 through a flow control valve 17.

In an excavator which is provided with a pressure compensated valve and to which a load sensing valve is applied as described above, if a difference between a hydraulic pump discharge pressure value that is detected by the pressure sensor 12 detecting the discharge pressure of the hydraulic pump 1 and the maximum load pressure value detected by the maximum load pressure sensor 13 detecting the maximum load sensing pressure is equal to or higher than a preset value, the flow control valve 17 may operate to reduce the discharge flow rate of the hydraulic pump 1. That is, if the above-described pressure difference is high, the control unit 16 operates to reduce the discharge flow rate of the hydraulic pump 1, while if the above-described pressure difference is low, the control unit 16 operates to increase the discharge flow rate of the hydraulic pump 1.

That is, if the load pressure of the attachment actuator 5 is low, the load pressure of the swing motor 7 becomes the maximum load sensing pressure, and the opening area of the first pressure compensation valve 10, which has the load pressure that is lower than the maximum load sensing pressure, is reduced through the first and second pressure compensation valves 10 and 11. Through this, pressure is formed to correspond to the maximum load sensing pressure of the attachment actuator 5 and the swing motor 7, and thus combined operability can be secured.

On the other hand, in the case of a combined operation in which the swing motor 7 is operated by the operation of the swing operation device 3 and the attachment operation device 2 is operated at the same time, the load pressure on the swing side relatively becomes very high. Due to this, a spool of the first pressure compensation valve 10 connected to the attachment is shifted to be almost closed, and thus the flow rate that is supplied to the attachment actuator 5 becomes low. Accordingly, the attachment, such as a boom, is hardly operated to lower the combined operability.

DETAILED DESCRIPTION OF THE INVENTION

Technical Problems

Therefore, the present invention has been made to solve the above-mentioned problems occurring in the related art, and one embodiment of the present invention is related to a hydraulic system for a construction machine, which can improve operability and a fuel ratio when a combined operation of an attachment of the equipment having a pressure compensation valve and a swing device.

Technical Solution

In accordance with an aspect of the present invention, there is provided a hydraulic system for a construction machine, which includes a variable displacement hydraulic pump connected to an engine; an attachment operation device and a swing operation device outputting operation signals in proportion to operator's operation amounts; at least one attachment actuator connected to a discharge flow path of the hydraulic pump to be driven by the operation of the attachment operation device; a first control valve installed in the discharge flow path and shifted to control a start, a stop, and a direction change of the actuator in response to the operation of the attachment operation device; a swing motor connected to a flow path branched from the discharge flow path to be driven by the operation of the swing operation device; a second control valve installed in the flow path and shifted to control a start, a stop, and a direction change of the swing motor in response to the operation of the swing operation device; a check valve installed in a flow path for detecting load pressures of the attachment actuator to take a maximum pressure of the detected load pressures; a first pressure compensation valve installed on a downstream side of the discharge flow path to have an opening amount that is controlled by a difference between the maximum load sensing pressure and the pressure on the downstream side of the discharge flow path; a second pressure compensation valve installed on the downstream side of the flow path to have an opening amount that is controlled by a difference between the maximum load sensing pressure and the pressure on the downstream side of the flow path; a pressure sensor detecting a discharge pressure of the hydraulic pump; a maximum load pressure sensor detecting a pressure of a maximum load sensing pressure line; an attachment operation amount detection means for detecting the operation amount of the attachment operation device; a swing operation amount detection means for detecting the operation amount of the swing operation device; and a control unit receiving an input of detection values of the pressure sensor of the hydraulic pump, the maximum load pressure sensor, the attachment operation amount detection means, and the swing operation amount detection means, and outputting a control signal for controlling a discharge flow rate of the hydraulic pump through a flow control valve, wherein one of output ports of the first pressure compensation valve is connected to the attachment actuator through a spool of the first control valve, and the other of the output ports thereof is connected to the maximum load sensing pressure line, and wherein one of output ports of the second pressure compensation valve is connected to the swing motor through a spool of the second control valve, and the other of the output ports thereof is not connected to the maximum load sensing pressure line, but is connected to a swing load pressure sensor for detecting a load pressure of the swing motor.

Preferably, in the case where the attachment operation device and the swing operation device include hydraulic joysticks, the attachment operation amount detection means and the swing operation amount detection means include pressure sensors.

In the case where the attachment operation device and the swing operation device include electrical joysticks, the attachment operation amount detection means and the swing operation amount detection means include potentiometers. In the case where the attachment operation device and the swing operation device include electrical joysticks, the attachment operation amount detection means and the swing operation amount detection means include hall sensors.

Advantageous Effect

The hydraulic system for a construction machine as configured above according to the aspect of the present invention has the following advantages.

When the combined operation of the swing device and the attachment is performed, workability is improved through improvement of operability. Further, if the difference between the load pressures of the hydraulic pump and the attachment exceeds the preset value, the discharge flow rate of the hydraulic pump is controlled to be reduced and thus the fuel ratio can be improved.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1:
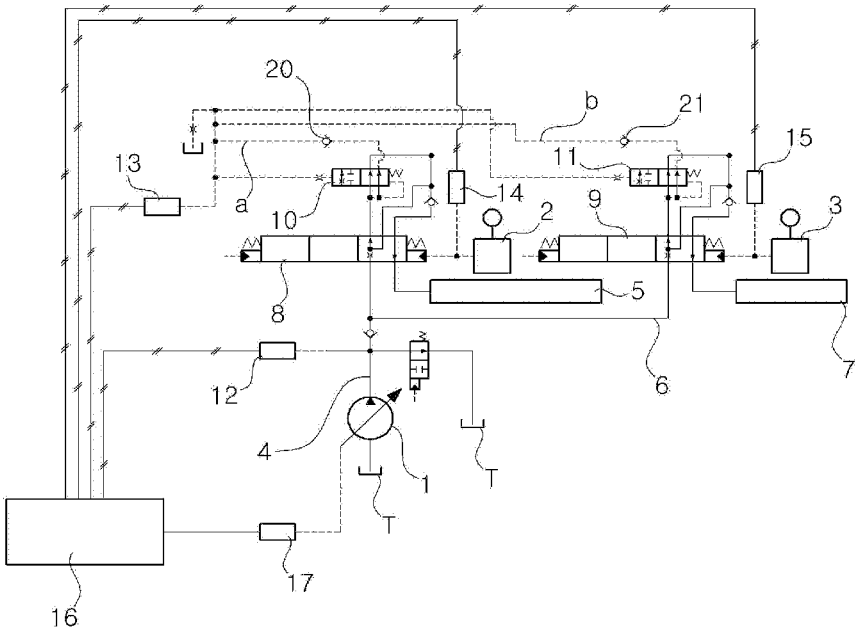
FIG. 1 is a hydraulic circuit diagram of a hydraulic system for a construction machine in the related art.

1: variable displacement hydraulic pump
2: attachment operation device
3: swing operation device
4: discharge flow rate
5: attachment actuator
6: flow path
7: swing motor
8: first control valve
9: second control valve
10: first pressure compensation valve
11: second pressure compensation valve
12: hydraulic pump discharge pressure sensor
13: maximum load pressure sensor
14: attachment operation amount detection means
15: swing operation amount detection means
16: control unit
17: hydraulic pump flow control valve
18: swing load pressure sensor
19: maximum load sensing pressure line

PREFERRED EMBODIMENTS OF THE INVENTION

Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 2:
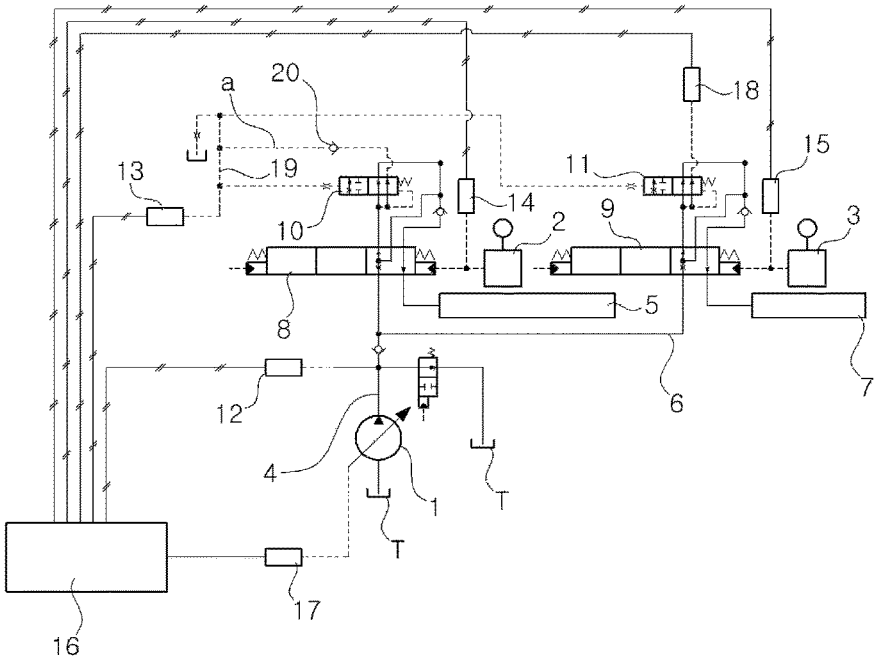
FIG. 2 is a hydraulic circuit diagram of a hydraulic system for a construction machine according to an embodiment of the present invention.

A hydraulic system for a construction machine according to an embodiment of the present invention, as illustrated in FIG. 2, includes a variable displacement hydraulic pump (hereinafter referred to as a "hydraulic pump") 1 connected to an engine (not illustrated); an attachment operation device (actuator joystick) 2 and a swing operation device (swing joystick) 3 outputting operation signals in proportion to operator's operation amounts; at least one attachment actuator 5 (in the drawing, only one attachment actuator is illustrated, but hydraulic actuators for operating a boom, an arm, and the like, may be provided) connected to a discharge flow path 4 of the hydraulic pump 1 to be driven by the operation of the attachment operation device 2; at least one first control valve (attachment spool) 8 installed in the discharge flow path 4 and shifted to control a start, a stop, and a direction change of the actuator 5 in response to the operation of the attachment operation device 2; a swing motor 7 connected to a flow path 6 branched from the discharge flow path 4 to be driven by the operation of the swing operation device 3; a second control valve (swing spool) 9 installed in the flow path 6 and shifted to control a start, a stop, and a direction change of the swing motor 7 in response to the operation of the swing operation device 3; a check valve 20 installed in a flow path a for detecting load pressures of the attachment actuator 5 to take a maximum pressure of the detected load pressures; a first pressure compensation valve 10 installed on a downstream side of the discharge flow path 4 to have an opening amount that is controlled by a difference between the maximum load sensing pressure and the pressure on the downstream side of the discharge flow path 4; a second pressure compensation valve 11 installed on the downstream side of the flow path 6 to have an opening amount that is controlled by a difference between the maximum load sensing pressure and the pressure on the downstream side of the flow path 6; a pressure sensor 12 detecting a discharge pressure of the hydraulic pump 1; a maximum load pressure sensor 13 detecting a pressure of a maximum load sensing pressure line 19; an attachment operation amount detection means 14 for detecting the operation amount of the attachment operation device 2; a swing operation amount detection means 15 for detecting the operation amount of the swing operation device 3; and a control unit 16 receiving an input of detection values of the pressure sensor 12 for detecting the discharge pressure of the hydraulic pump 1, the maximum load pressure sensor 13, the attachment operation amount detection means 14 for detecting the operation amount of the attachment operation device 2, and the swing operation amount detection means 15 for detecting the operation amount of the swing operation device 3, and outputting a control signal for controlling a discharge flow rate of the hydraulic pump 1 through a flow control valve 17, wherein one of output ports of the first pressure compensation valve 10 is connected to the attachment actuator 5 through a spool of the first control valve 8, and the other of the output ports thereof is connected to the maximum load sensing pressure line 19, and wherein one of output ports of the second pressure compensation valve 11 is connected to the swing motor 7 through a spool of the second control valve 9, and the other of the output ports thereof is not connected to the maximum load sensing pressure line 19, but is connected to a swing load pressure sensor 18 for detecting a load pressure of the swing motor 7.

According to the hydraulic system as configured above, the control unit 16 compares the load pressure value of the swing motor 7 that is detected by a swing load pressure sensor 18 with the maximum load sensing pressure value detected by the maximum load pressure sensor 13, and selects a higher pressure value of the compared pressure values. If the difference between the selected pressure value and the pressure value detected by the hydraulic pump discharge pressure sensor 12 exceeds a preset value, the control unit 16 operates to reduce the discharge flow rate of the hydraulic pump 1 to improve the fuel ratio.

On the other hand, in the case where the attachment operation device 2 and the swing operation device 3 include hydraulic joysticks, the attachment operation amount detection means 14 and the swing operation amount detection means 15 may include pressure sensors.

In the case where the attachment operation device 2 and the swing operation device 3 include electrical joysticks, the attachment operation amount detection means 14 and the swing operation amount detection means 15 may include potentiometers.

In the case where the attachment operation device 2 and the swing operation device 3 include electrical joysticks, the attachment operation amount detection means 14 and the swing operation amount detection means 15 may include hall sensors.

Hereinafter, a use example of the hydraulic system for a construction machine according to an embodiment of the present invention will be described in detail.

As shown in FIG. 2, in the case of a combined operation in which the swing motor 7 is operated by an operator's operation of the swing operation device 3 and the attachment, such as a boom or an arm, is operated by the operation of the attachment operation device 2 at the same time, the load pressure on the swing side relatively becomes very high. At this time, since a flow path through which the load pressure on the swing side is transferred to the maximum load sensing pressure line 19 is in an intercepted state, excessive pressure that is generated on the side of the swing motor 7 is not transferred to the maximum load sensing pressure line 19. Through this, the spool of the first pressure compensation valve 10 that is connected to the attachment, such as a boom, is not closed, and thus hydraulic fluid that is discharged from the hydraulic pump 1 can be smoothly supplied to the attachment actuator 5, such as a boom.

Accordingly, even in the case of the combined operation of the attachment, such as a boom, and the swing device of the excavator, the combined operability can be improved.

On the other hand, if the swing motor 7 is solely operated for the swing operation, the pressure that is generated on the side of the swing motor 7 is not transferred to the maximum load sensing pressure line 19, and thus the pressure value of the maximum load sensing pressure line 19 that is detected by the maximum load pressure sensor 13 becomes equal to the pressure value of a hydraulic tank T. In this case, the pressure value that is detected by the hydraulic pump discharge pressure sensor 12 is equal to the load pressure of the swing motor 7, and the pressure value that is detected by the maximum load pressure sensor 13 is equal to the pressure value of the hydraulic tank T. If the difference between the pressure values exceeds the preset pressure value, the control unit 16 controls the hydraulic pump flow control valve 17 to reduce the discharge flow rate of the hydraulic pump 1. Accordingly, during the sole swing operation, the operability is lowered.

The lowering of the operability during the sole swing operation can be solved by the swing load pressure sensor 18 that detects the load pressure of the swing motor 7. The swing load pressure sensor 18 is installed in the flow path in which the load pressure on the side of the swing motor 7 is intercepted by the swing load pressure sensor 18 so that the load pressure on the side of the swing motor 7 is not transferred to the maximum load sensing pressure line 19. Through this, the swing load pressure sensor 18 detects the load pressure that is generated on the side of the swing motor 7 and transfers a detection signal to the control unit 16. Accordingly, the control unit 16 compares the load pressure on the side of the swing motor 7 and the pressure that is detected by the maximum load pressure sensor 13 to select a higher pressure value as a reference value. If the difference between the selected pressure value and the pressure value detected by the hydraulic pump discharge pressure sensor 12 exceeds the preset value, the control unit 16 operates to reduce the discharge flow rate of the hydraulic pump 1, and thus operability can be secured even in the case of the sole swing operation.

As described above, in the case of the combined operation of the swing device and the attachment, such as a boom, the load pressure that is generated on the side of the swing motor 7 is not transferred to the maximum load sensing pressure line 19. Due to this, the spool of the first pressure compensation valve 10 is not closed, and thus the hydraulic fluid of the hydraulic, pump 1 can be smoothly supplied to the attachment actuator 5.

Further, in the case of the sole swing operation, if the difference between the higher value of the pressure value on the side of the swing motor 7 detected by the swing load pressure sensor 18 and the pressure value of the maximum load sensing pressure line 19 detected by the maximum load pressure sensor 13 and the pressure value detected by the hydraulic pump discharge pressure sensor 12 exceeds the preset value, the control unit 16 operates to reduce the discharge flow rate of the hydraulic pump 1. Through this, if the difference between the load pressure on the side of the swing motor 7 and the pressure value detected by the hydraulic pump discharge pressure sensor 12 does not exceed the preset value during the sole swing operation, the hydraulic fluid from the hydraulic pump 1 can be smoothly supplied to the side of the swing motor 7.

INDUSTRIAL APPLICABILITY

As apparent from the above description; according to the hydraulic system for a construction machine according to the embodiment of the present invention, when the combined operation of the swing device and the attachment, such as a boom, is performed, workability can be improved. Further, if the difference between the load pressures of the hydraulic pump and the attachment exceeds the preset value, the discharge flow rate of the hydraulic pump is controlled to be reduced and thus the fuel ratio can be improved.

The invention claimed is:

1. A hydraulic system for a construction machine, comprising:

a variable displacement hydraulic pump connected to an engine;

an attachment operation device and a swing operation device outputting operation signals in proportion to operator's operation amounts;

at least one attachment actuator connected to a discharge flow path of the hydraulic pump to be driven by the operation of the attachment operation device;

a first control valve installed in the discharge flow path and shifted to control a start, a stop, and a direction change of the actuator in response to the operation of the attachment operation device;

a swing motor connected to a flow path branched from the discharge flow path to be driven by the operation of the swing operation device;

a second control valve installed in the flow path and shifted to control a start, a stop, and a direction change of the swing motor in response to the operation of the swing operation device;

a first pressure compensation valve installed on a downstream side of the discharge flow path to have an opening amount that is controlled by a difference between a maximum load sensing pressure and a pressure on the downstream side of the discharge flow path;

a second pressure compensation valve installed on the downstream side of the flow path to have an opening amount that is controlled by a difference between the maximum load sensing pressure and a pressure on the downstream side of the flow path;

a pressure sensor detecting a discharge pressure of the hydraulic pump;

a maximum load pressure sensor detecting a pressure of a maximum load sensing pressure line;

an attachment operation amount detection means for detecting the operation amount of the attachment operation device;

a swing operation amount detection means for detecting the operation amount of the swing operation device; and a control unit receiving an input of detection values of the pressure sensor of the hydraulic pump, the maximum load pressure sensor, the attachment operation amount detection means, and the swing operation amount detection means, and outputting a control signal for controlling a discharge flow rate of the hydraulic pump, wherein one of output ports of the first pressure compensation valve is connected to the attachment actuator through a spool of the first control valve, and another of the output ports thereof is connected to the maximum load sensing pressure line, and wherein one of output ports of the second pressure compensation valve is connected to the swing motor through a spool of the second control valve, and another of the output ports thereof is not connected to the maximum load sensing pressure line, but is connected to a swing load pressure sensor for detecting a load pressure of the swing motor.

2. The hydraulic system for a construction machine according to claim 1, wherein the attachment operation device and the swing operation device include hydraulic joysticks, and the attachment operation amount detection means and the swing operation amount detection means include pressure sensors.

3. The hydraulic system for a construction machine according to claim 1, wherein the attachment operation device and the swing operation device include electrical joysticks, and the attachment operation amount detection means and the swing operation amount detection means include potentiometers.

4. The hydraulic system for a construction machine according to claim 1, wherein the attachment operation device and the swing operation device include electrical joysticks, and the attachment operation amount detection means and the swing operation amount detection means include hall sensors.

* * * * *